US010250992B2

(12) United States Patent
Linghu et al.

(10) Patent No.: US 10,250,992 B2
(45) **Date of Patent: *Apr. 2, 2019**

(54) SPEAKER

(71) Applicant: AAC Technologies Pte, Ltd., Singapore (SG)

(72) Inventors: Ronglin Linghu, Shenzhen (CN); Bo Xiao, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 15/646,144

(22) Filed: Jul. 11, 2017

(65) Prior Publication Data

US 2018/0302722 A1 Oct. 18, 2018

(30) Foreign Application Priority Data

Apr. 15, 2017 (CN) ..... 2017 1 0246461

(51) Int. Cl.

| | |
|---|---|
| ***H04R 1/00*** | (2006.01) |
| ***H04R 9/06*** | (2006.01) |
| ***H04R 7/18*** | (2006.01) |
| ***H04R 7/12*** | (2006.01) |
| ***H04R 9/02*** | (2006.01) |

(52) U.S. Cl.

CPC ..... *H04R 9/06* (2013.01); *H04R 7/12* (2013.01); *H04R 7/18* (2013.01); *H04R 9/025* (2013.01); *H04R 2400/11* (2013.01)

(58) Field of Classification Search

CPC combination set(s) only.
See application file for complete search history.

(56) References Cited

U.S. PATENT DOCUMENTS 9,055,359 B2 * 6/2015 Kamimura ..... H04R 9/025
2004/0240702 A1 * 12/2004 Kaiwa ..... H04R 1/06 381/423

* cited by examiner

*Primary Examiner* — Amir H Etesam
(74) *Attorney, Agent, or Firm* — Na Xu; IPro, PLLC

(57) ABSTRACT

The present disclosure discloses a speaker. The speaker includes a fixing unit and a vibration unit; the fixing unit includes a frame, a lower clamping plate, a main magnet, an auxiliary magnet and an upper clamping plate, the lower clamping plate and the frame are assembled to define accommodating space to accommodate the main magnet, a magnetic gap is defined between the main magnet and the auxiliary magnet, and the upper clamping plate fixes the auxiliary magnet in the accommodating space; the upper clamping plate includes body portion and bendings, the body portion matches the auxiliary magnet in shape, the auxiliary magnet is clamped between the body portion and the lower clamping plate, the auxiliary magnet is recessed with respect to each of the bendings to define avoiding portions at an outer side of the auxiliary magnet, and each of the bendings passes through one of the avoiding portions.

10 Claims, 4 Drawing Sheets

SPEAKER

TECHNICAL FIELD

The present disclosure relates to the field of electroacoustic conversion technologies and, specifically, relates to a speaker.

BACKGROUND

With the development of technologies, audio devices are becoming more and more popular. People not only have demands on video/audio play function of an audio device but also have increasing demands on reliability of the audio device. Especially, with the arrival of 4G era, mobile multimedia technologies is developing accordingly, and many audio devices have a variety of entertaining functions, such as video playing, digital photographing, gaming, GPS navigation and so on. All these functions require an electronic element in the audio device to be more and more precise and compact. However, the more the electronic elements are, the worse the reliability of the audio device is. A speaker is a commonly used electronic element in the audio device, and is mainly used for playing audio signals, and the voice quality of the speaker directly influences an experience of a user when using these mobile electronic devices.

In the relevant art, the speaker cannot effectively fix and protect a magnetic unit in the speaker when the audio device falls off.

Accordingly, it is necessary to provide a new speaker to solve the above-mentioned problem.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

In order to clearly and completely describe technical solutions of the present disclosure, exemplary embodiments of the present disclosure are illustrated as follows with reference to the drawings. Obviously, the illustrated embodiments are merely a part of the embodiments of the present disclosure rather than all the embodiments of the present disclosure. Based on the embodiments in the present disclosure, all other embodiments obtained by those skilled in the art without paying any creative efforts shall fall into the protection scope of the present invention.

Figure 1:
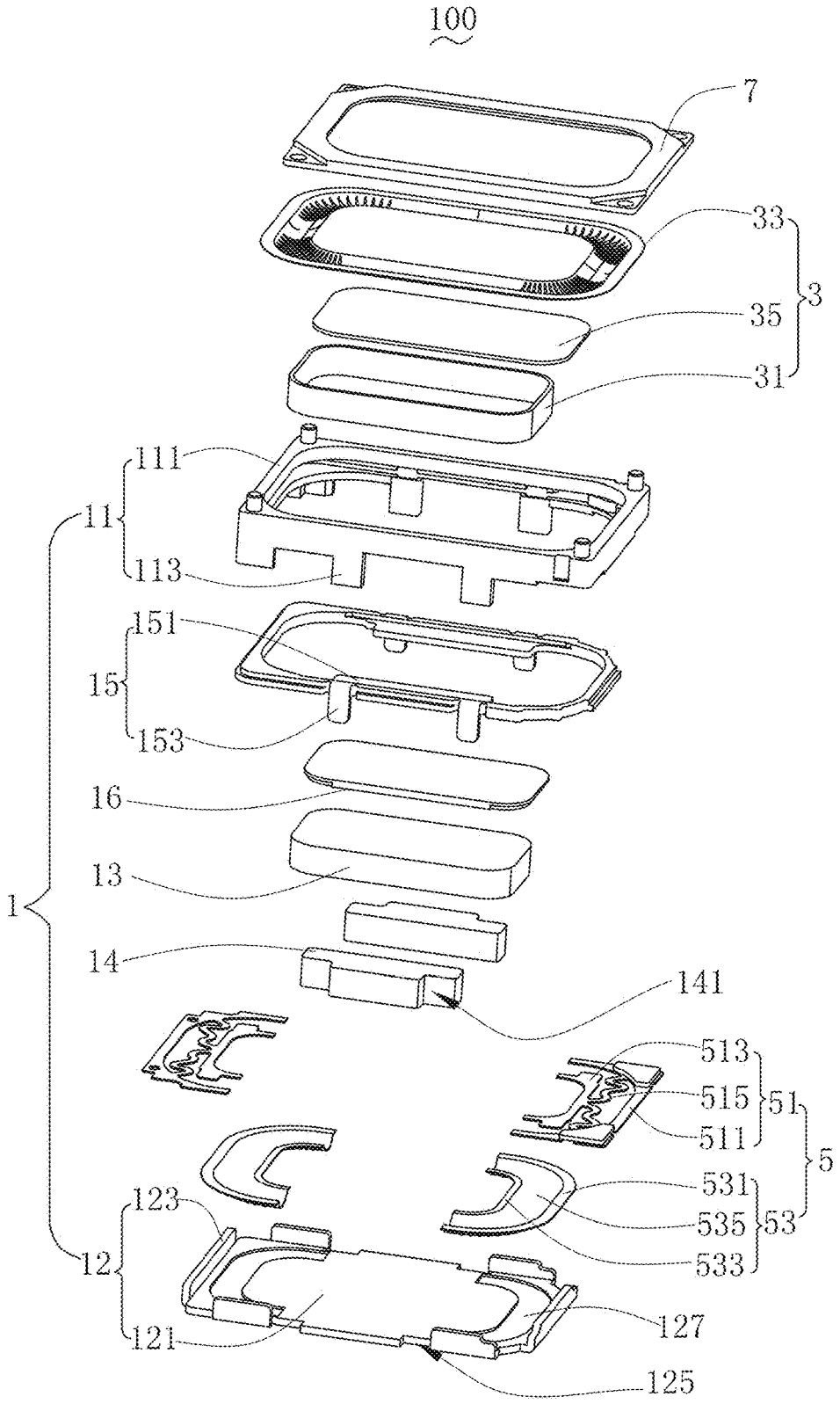
FIG. 1 is an exploded view of a speaker according to an exemplary embodiment of the present disclosure.
Figure 2:
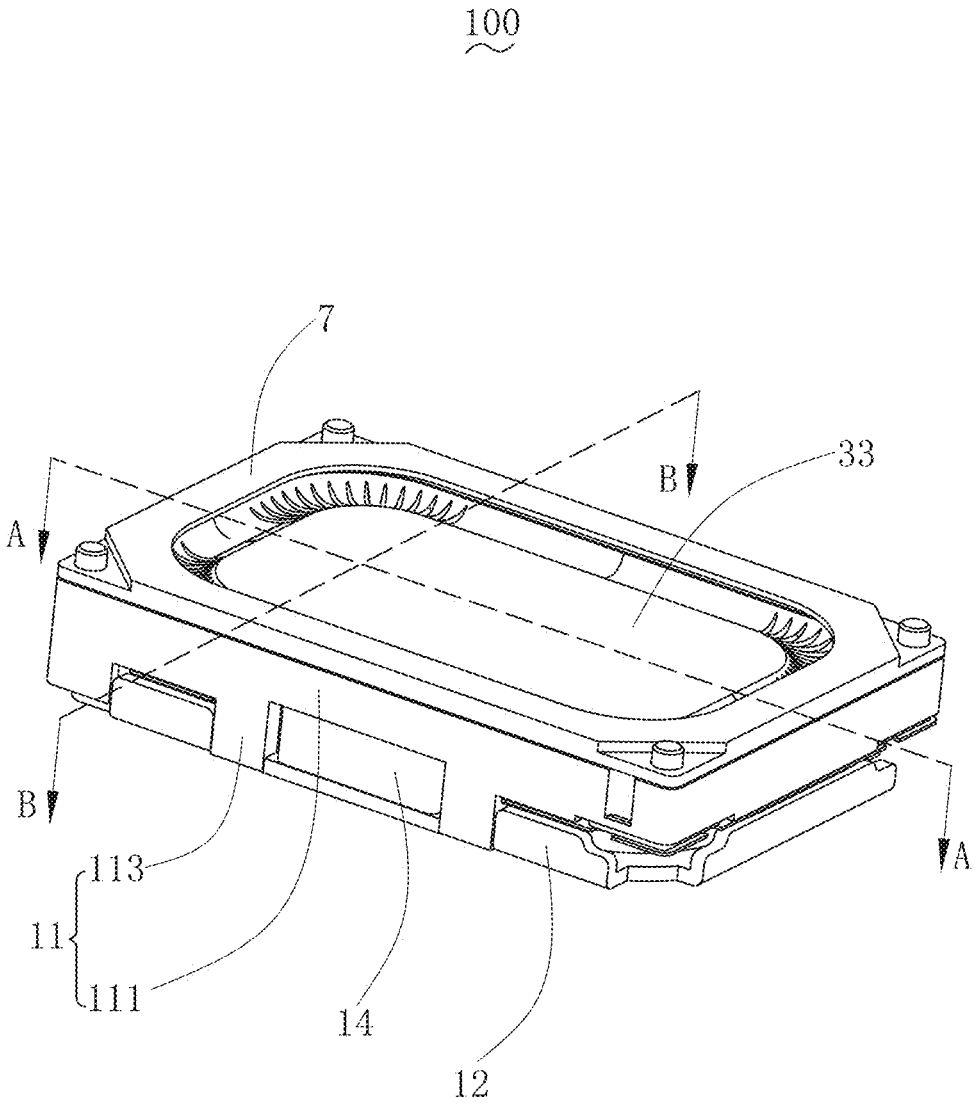
FIG. 2 is a structural schematic diagram of the speaker in FIG. 1 after the speaker is assembled.
Figure 3:
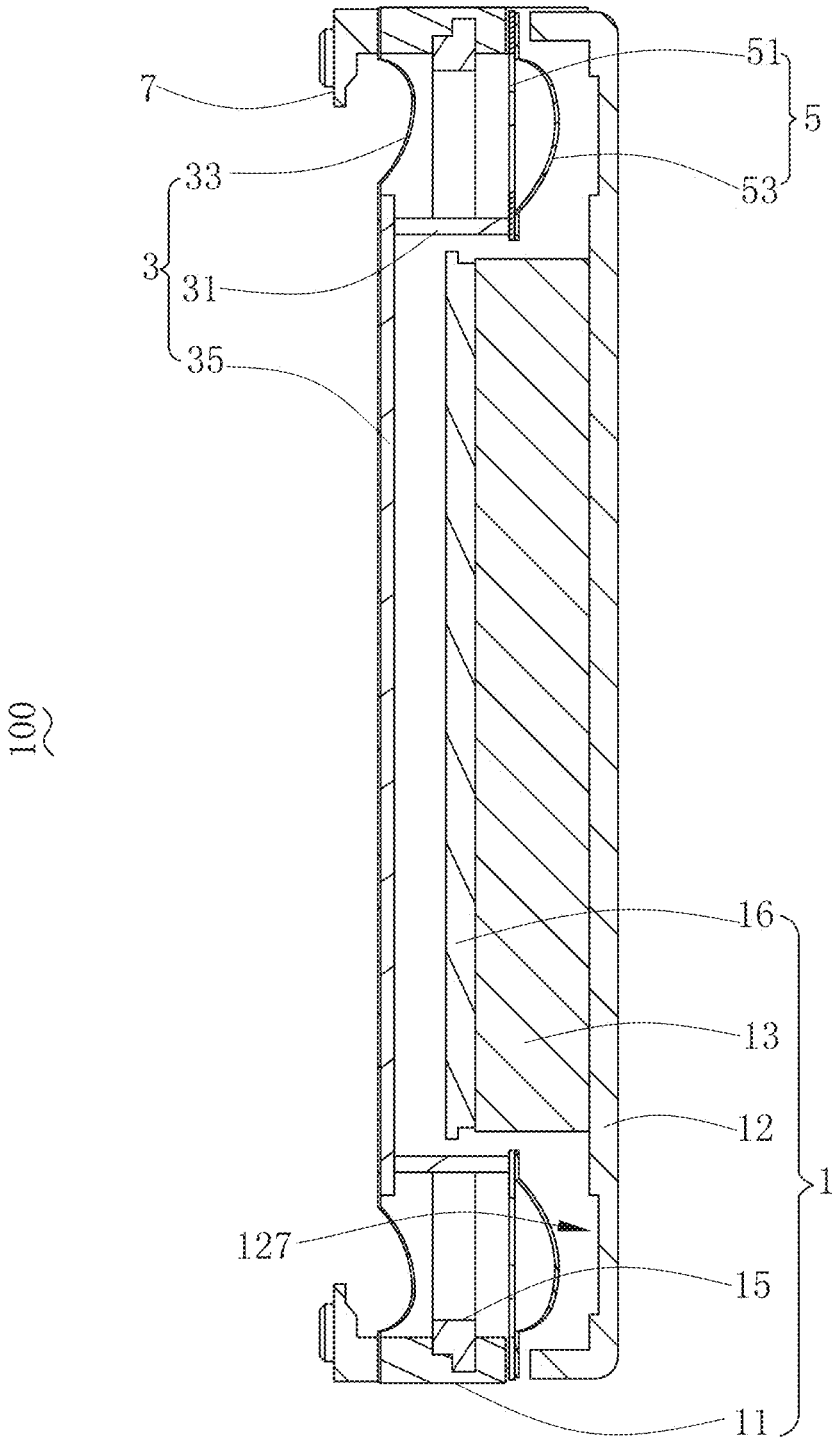
FIG. 3 is a sectional view of the speaker shown in FIG. 2 along A-A direction.
Figure 4:
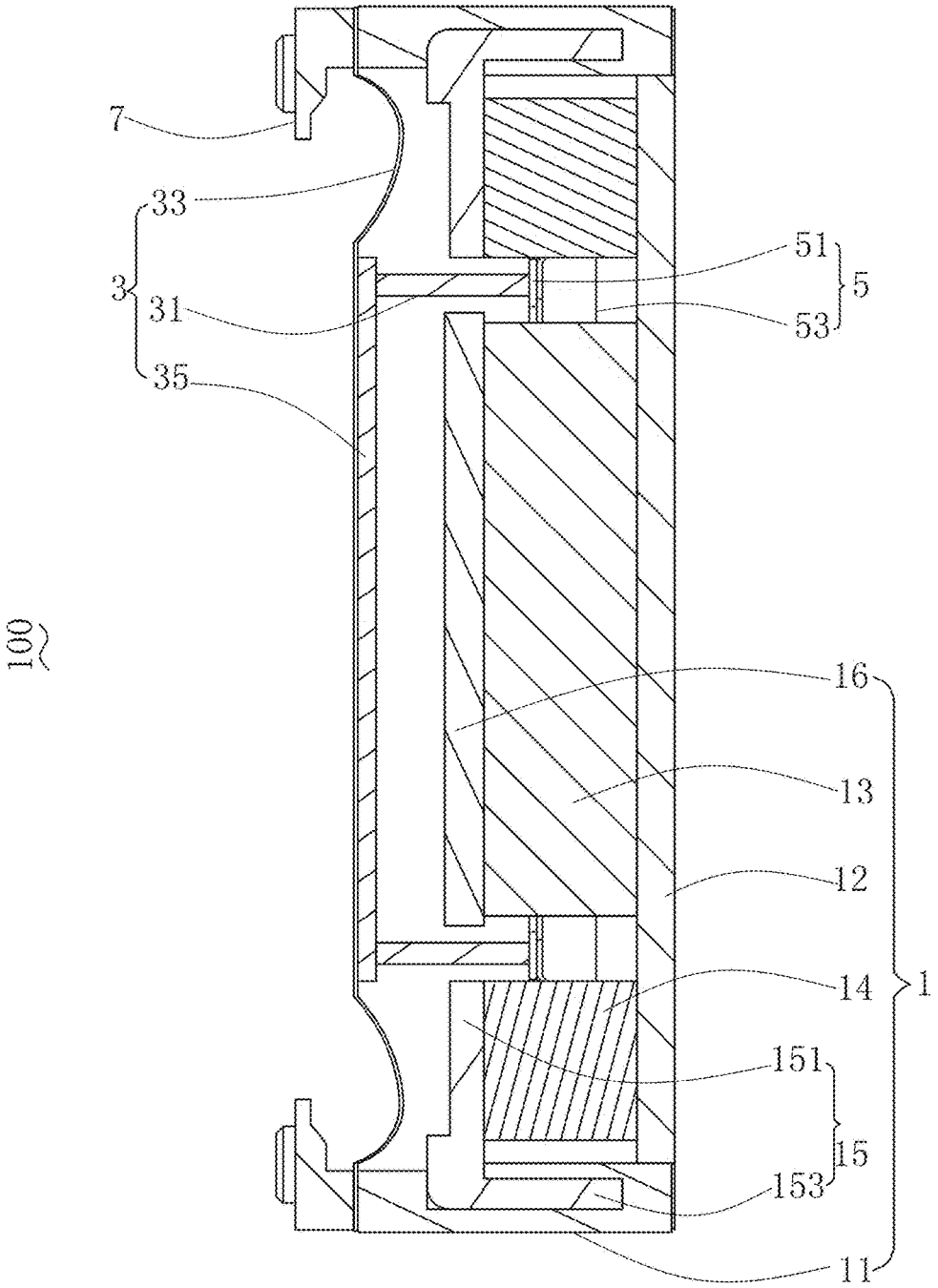
FIG. 4 is a sectional view of the speaker shown in FIG. 2 along B-B direction.

With reference to FIGS. 1-4, a speaker 100 is provided. The speaker 100 includes a fixing unit 1 and a vibration unit 3, the vibration unit 3 is fixedly held by the fixing unit 1 and is configured to vibrate and sound.

The fixing unit 1 includes a frame 11, a lower clamping plate 12, a main magnet 13, an auxiliary magnet 14 and an upper clamping plate 15. The lower clamping plate 12 and the frame 11 are assembled to define accommodating space. The main magnet 13 is accommodated in the accommodating space and is arranged on the lower clamping plate 12. A magnetic gap is defined between the main magnet 13 and the auxiliary magnet 14. The upper clamping plate 15 is attached onto the auxiliary magnet 14 and is fixed with the frame 11, and the upper clamping plate 15 fixes the auxiliary magnet 14 in the accommodating space. The fixing unit 1 further includes a pole plate 16, and the pole plate 16 is fixed at a side of the main magnet 13 away from the lower clamping plate 12. Each of the lower clamping plate 12, the upper clamping plate 15 and the pole plate 16 is made of a magnetic material.

The upper clamping plate 15 includes a body portion 151 and a plurality of bendings 153, the body portion 151 and the auxiliary magnet 15 are matched in shape. Each of the plurality of bendings 153 extends from the body portion 151 toward the lower clamping plate 12. The body portion 151 and the pole plate 16 are located in a same plane, an outer edge of the body portion 151 and the frame 11 are integrally formed by injection molding. The plurality of bendings 153 extends into the accommodating space, and the auxiliary magnet 14 is clamped between the body portion 151 and the lower clamping plate 12. The body portion 151 may be formed as a continuous annular structure, or be formed as a separated structure including a plurality of parts spaced from each other. In the present embodiment, the body portion 151 is continuously formed as an annular structure.

The auxiliary magnet 14 is recessed with respect to each of the plurality of bendings 153 to define a plurality of avoiding portions 141 at an outer side of the auxiliary magnet 14. The present disclosure has no limitations on positions of the plurality of avoiding portions 141. In an exemplary embodiment, the speaker includes two auxiliary magnets 14, the upper clamping plate 15 includes four bendings 153, the four bendings 153 are divided into two groups, and each group includes two bendings 153, and the two bendings 153 of each group are located at two opposite side walls of the body portion 151, respectively. The two auxiliary magnets 14 are located at two long axis edges of the main magnet 13, respectively. Each of the two auxiliary magnets 14 includes two ends, and each of the two ends defines one avoiding portion 141, i.e., each of the two auxiliary magnets 14 defines two avoiding portions 141. The two bendings 153 of each group pass through the two avoiding portions 141, respectively. Thus, each of the two auxiliary magnets 14 is partially clamped between two of the four bendings 153. Each of the two auxiliary magnets 14 are clamped between the lower clamping plate 12 and the upper clamping plate 15, and each of the four bendings 153 passes through one of the two avoiding portions 141 of each of the two auxiliary magnets 14, so that a position of each of the two auxiliary magnets 14 is limited, and thus the magnetic circuit structure of the speaker can be effectively protected when the speaker falls off.

The frame 11 includes a main body 111 and a plurality of vertical columns 113, the main body 111 is shaped as an annular structure, and each of the plurality of vertical columns 113 extends from the main body 111 toward the lower clamping portion 12. The main body 111 and an outer edge of the body portion 151 of the upper clamping plate 15 are integrally formed by injection molding, and at least one of the plurality of vertical columns 113 and at least one of the four bendings 153 are integrally molded in one-to-one correspondence. The present disclosure has no limits on quantity and shape of the plurality of vertical columns 113. In the present embodiment, a cross section of each of the plurality of vertical columns 113 is square, the frame 11 includes four vertical columns 113, and the four vertical columns 113 and the four bendings 153 are integrally molded in one-to-one correspondence. Since the plurality of vertical columns 113 are provided and the plurality vertical columns 113 and the plurality of bendings 153 are integrally molded, the strength of the plurality of bendings 153 is improved and thus the speaker 100 will be better protected when falling off.

The lower clamping plate 12 includes a supporting plate 121 and a flanging 123, the supporting plate 121 is configured to support the main magnet 13 and the auxiliary magnet 14. The flanging 123 bends from an edge of the supporting plate 121 toward the frame 11.

The supporting plate 121 defines a plurality of notches 125 thereon. The plurality of notches 125 directly faces the plurality of vertical columns 113, respectively. An end of each of the vertical columns 113 away from the main body 111 is inserted into one of the plurality of notches 125. As a result of the plurality of notches 125 and inserting of the plurality of vertical columns 113, the lower clamping plate 12 and the frame 11 can be conveniently positioned and fixed.

The vibration unit 3 includes a voice coil 31 and a voice diaphragm 33, the voice coil 31 is inserted into the magnetic gap, and the voice diaphragm 33 is fixedly held by the frame 11 and is driven by the voice coil 31. The speaker further includes a reinforcing plate 35 fixed on the voice diaphragm 33. The reinforcing plate 35 may be located at a side of the voice diaphragm 33 toward the main magnet 13, or at a side of the voice diaphragm 33 away from the main magnet 13. In the present embodiment, the reinforcing plate 35 is located at a side of the voice diaphragm 33 toward the main magnet 13, and the voice coil 31 is fixed on the reinforcing plate 35.

The speaker 100 further includes two elastic supporting members 5, each of the two elastic supporting member 5 is fixedly connected with an end of the voice coil 31 away from the voice diaphragm 33. The two auxiliary magnets 14 face each other and are arranged at two long axis edges of the voice coil 31, respectively. The two elastic supporting members 5 are located at two short axis edges of the voice coil 31, respectively. An external edge of each of the two elastic supporting members 5 corresponds to the flanging 123.

Each of the two elastic supporting members 5 includes a flexible circuit board 51, the flexible circuit board 51 includes a first fixing portion 511, a second fixing portion 513 and an elastic connecting portion 515. The first fixing portion 511 is fixedly connected with the frame 11, the second fixing portion 513 is connected with the voice coil 31, and the elastic connecting portion 515 connects the first fixing portion 511 with the second fixing portion 513.

Each of the two elastic supporting members 5 further includes a diaphragm 53 fixedly connected with the flexible circuit board 51. The diaphragm 53 includes a third fixing portion 531, a fourth fixing portion 533 and a recessed portion 535. The third fixing portion 531 is connected with the first fixing portion 511, the fourth fixing portion 533 is connected with the second fixing portion 513, and the recessed portion 535 connects the third fixing portion 531 with the fourth fixing portion 533. The depressed portion 535 is recessed in a direction away from the voice diaphragm 33. The supporting plate 121 defines a slot 127 thereon, configured to accommodate the recessed portion 535. As a result of the two elastic supporting members 5, the speaker 100 can vibrate to sound, and the voice coil 31 does not readily swing, so that sounding performance of the speaker 100 is improved; further, the diaphragm 53 can also improve sounding performance of the speaker 100.

The speaker 100 further includes a top cover 7, and the top over is hollow. The top cover 7 is fixed at a side of the voice diaphragm 33 away from the frame 11. As a result of the top cover 7, the reliability of the fixing of voice diaphragm 33 is improved.

The speaker provided by the present disclosure has the following beneficial effects: the auxiliary magnet 14 is clamped between the lower clamping plate 12 and the upper clamping plate 15, and the auxiliary magnet 14 is positioned in a way that the plurality of bendings 153 pass through the plurality of avoiding portions 141, so that the magnetic circuit of the speaker can be effectively protected when the speaker falls off; further, as a result of the plurality of vertical columns 113 and the configuration that the plurality vertical columns 113 and the plurality of bendings 153 are integrally molded, the strength of the plurality of bendings 153 is improved and thus the speaker is better protected when falling off. Additionally, as a result of the plurality of notches 125 and the configuration that the plurality of vertical columns 113 are inserted in the plurality of notches 125, the lower clamping plate 12 and the frame 11 can be conveniently positioned and fixed, so as to simplify the positioning process, improve the manufacturing efficiency and reduce cost.

The above are merely exemplary embodiments of the present disclosure. It should be noted that, those skilled in the art can make improvements to the present disclosure without departing from the invention concept of the present disclosure, and all these improvements shall fall into the protection scope of the present disclosure.

What is claimed is:

1. A speaker, comprising:

a fixing unit, the fixing unit comprising a frame, a lower clamping plate, a main magnet, an auxiliary magnet and an upper clamping plate; and a vibration unit fixedly held by the fixing unit and configured to vibrate and sound;

wherein the lower clamping plate and the frame are assembled to cooperatively define accommodating space, the main magnet is accommodated in the accommodating space and is arranged on the lower clamping plate, a magnetic gap is defined between the main magnet and the auxiliary magnet, the upper clamping plate is arranged on the auxiliary magnet and is fixed with the frame, and the upper clamping plate fixes the auxiliary magnet in the accommodating space;

wherein the upper clamping plate comprises a body portion and a plurality of bendings, the body portion matches the auxiliary magnet in shape, each of the plurality of bendings extends from the body portion toward the lower clamping plate, the auxiliary magnet is clamped between the body portion and the lower clamping plate, the auxiliary magnet is recessed with respect to each of the plurality of bendings to define a plurality of avoiding portions at an outer side of the auxiliary magnet, and each of the plurality of bendings passes through one of the plurality of avoiding portions.

2. The speaker as described in claim 1, wherein an outer edge of the body portion and the frame are integrally formed by injection molding, and the plurality of bendings extend into the accommodating space.

3. The speaker as described in claim 2, wherein the frame comprises a main body and a plurality of vertical columns, the main body is shaped as an annular structure, the plurality of vertical columns extends from the body portion toward the lower clamping plate and is spaced from each other, and the main body corresponds to the body portion.

4. The speaker as described in claim 3, wherein at least one of the plurality of vertical columns and at least one of the four bendings are integrally molded in one-to-one correspondence.

5. The speaker as described in claim 4, wherein the lower clamping plate defines a plurality of notches thereon, the plurality of notches directly faces the plurality of vertical columns, respectively; an end of each of the plurality of vertical columns away from the main body is inserted in one of the plurality of notches.

6. The speaker as described in claim 1, wherein the fixing unit further comprises a pole plate, and the pole plate is fixed at a side of the main magnet away from the lower clamping plate.

7. The speaker as described in claim 1, wherein the vibration unit comprises a voice coil and a voice diaphragm, the voice coil is inserted into the magnetic gap, and the voice diaphragm 33 is fixedly held by the frame and is driven by the voice coil; the speaker further comprises an elastic supporting member, and the elastic supporting member is fixedly connected with an end of the voice coil far away from the voice diaphragm;

the voice coil is shaped as a runway structure, the speaker comprises at least one pair of auxiliary magnets, the at least one pair of auxiliary magnets faces each other and is symmetrically arranged at two long axis edges of the voice coil, and the elastic supporting member corresponds to a short axis edge of the voice coil.

8. The speaker as described in claim 7, wherein the elastic supporting member comprises a flexible circuit board, the flexible circuit board comprises a first fixing portion, a second fixing portion and an elastic connecting portion, the first fixing portion is fixedly connected with the frame, the second fixing portion is connected with the voice coil, and the elastic connecting portion connects the first fixing portion with the second fixing portion.

9. The speaker as described in claim 8, wherein the elastic supporting member further comprises a diaphragm fixedly connected with the flexible circuit board, the diaphragm comprises a third fixing portion, a fourth fixing portion and a recessed portion, the third fixing portion is connected with the first fixing portion, the fourth fixing portion is connected with the second fixing portion, the recessed portion connects the third fixing portion with the fourth fixing portion, and the recessed portion is recessed along a direction away from the voice diaphragm.

10. The speaker as described in claim 7, wherein the lower clamping plate comprises a supporting plate and a flanging, the supporting plate is configured to support the main magnet and the at least one pair of auxiliary magnets, the flanging bends from an edge of the supporting plate toward the frame, and the flanging is arranged at an outer edge of the elastic supporting member.

* * * * *